United States Patent [19]

Skolaude

[11] 4,099,945

[45] Jul. 11, 1978

[54] EFFICIENT AIR FRACTIONATION

[75] Inventor: Werner Skolaude, Munich, Germany

[73] Assignee: Linde Aktiengesellschaft, Wiesbaden, Germany

[21] Appl. No.: 736,212

[22] Filed: Oct. 27, 1976

[30] Foreign Application Priority Data

Oct. 28, 1975 [DE] Fed. Rep. of Germany ..... 2548222

[51] Int. Cl.[2] ..... F25J 3/04

[52] U.S. Cl. ..... 62/30; 62/38

[58] Field of Search ..... 62/38, 39, 29, 30

[56] References Cited

U.S. PATENT DOCUMENTS

| | | | |
|---|---|---|---|
| 2,526,996 | 10/1950 | Crawford | 62/39 |
| 3,083,544 | 4/1963 | Jakob | 62/29 |
| 3,605,422 | 9/1971 | Pryor et al. | 62/39 |

*Primary Examiner*—Norman Yudkoff
*Attorney, Agent, or Firm*—Millen & White

[57] ABSTRACT

In a process for the fractionation of air wherein the air is subjected to rectification in a high-pressure column and a low pressure column, wherein in a liquefaction cycle, nitrogen is withdrawn in the gaseous phase from the head of the high-pressure column and is liquefied by heating, compression, recooling, and expansion and recycled as liquid to the high-pressure column and wherein a gas, e.g., air is withdrawn from the high pressure column, is preheated, and is then expanded through a low-pressure expansion turbine, the improvement which comprises cooling the gas expanded in the low-pressure expansion turbine in indirect heat exchange with at least a portion of the nitrogen which is heated in the liquefaction cycle.

10 Claims, 4 Drawing Figures

EFFICIENT AIR FRACTIONATION

BACKGROUND OF THE INVENTION

This invention relates to a cryogenic gas-fractionation process and apparatus, and in particular to an air fractionation system employing two-stage low-temperature rectification with a nitrogen liquefaction cycle. In said cycle, nitrogen is withdrawn in the gaseous phase from the head of the high-pressure stage and is liquefied by heating, compression, recooling, and expansion and then recycled to the high-pressure stage. For maintaining a small temperature difference at the cold end of the primary heat exchanger, a low-pressure expansion turbine is used to expand preheated compressed gas, e.g., slightly fractionated air withdrawn from the bottom of the high pressure column. For further details of such a system, reference is made to U.S. Pat. No. 3,285,028.

Conventional processes of this type have the serious drawback that large temperature differences occur between the streams to be heated and those to be cooled, due to their temperature-dependent heat capacities in the cold section of the liquefaction cycle. By virtue of these large temperature differences, during heat exchange, the entropy of the system is substantially increased resulting in a loss in exergonic property.

SUMMARY OF THE INVENTION

An object of this invention is to provide an economically improved process operating with relatively small temperature differences, especially in the cold part of the liquefaction cycle.

Another object is to provide apparatus for conducting said process.

Upon further study of the specification and appended claims, further objects and advantages of this invention will become apparent to those skilled in the art.

To attain these objects, a step is provided wherein the gas expanded in the low-pressure expansion turbine is cooled by heat exchange with at least a portion of the nitrogen of the liquefaction cycle.

By this step according to the invention, the temperature differences are reduced in the cold portion of the liquefaction cycle, whereby the desired saving in energy is attained. Further significant advantages are obtained when the gas expanded in the low-pressure expansion turbine is air, or substantially air, the nitrogen content being about 78 to 100 percent by volume. Ordinarily, the expanded air is thereafter introduced into the low-pressure stage of the rectifying device. By cooling the air discharged from the turbine, in accordance with the invention, it is possible to operate the turbine at a higher temperature level, e.g., about 170° to 185° K while at the same time discharging air from the turbine via the heat exchanger into the low-pressure stage at acceptably low temperatures, e.g., about 98° to 105° K. The introduction of warmer air into the low-pressure stage has a detrimental effect on the rectification procedure, since liquid in the column would be vaporized by the thus-introduced warm air causing a change in the liquid to vapor ratio in the column. Conversely, the operation of the turbine at a higher temperature level, made possible by the procedure of this invention, affords, in turn, two decisive advantages. On the one hand, the refrigerating capacity is increased and on the other hand, it is possible to operate with a smaller amount of turbine throughput. A smaller turbine throughput quantity, in turn, leads to improved rectification conditions, since a smaller amount of air is withdrawn from the rectifying column, i.e., about 10 to 11% air is withdrawn as compared to the conventional amount which is about 12%. Accordingly, the net throughput rate through the system is increased in the same manner.

The process of this invention can also be used advantageously if the gas expanded in the low-pressure expansion turbine is nitrogen, or substantially nitrogen.

This invention is especially advantageous where a portion of the compressed cycle nitrogen is to be conventionally subjected to an engine expansion, before terminating the cooling, in a medium-pressure expansion turbine, i.e., operating at an input pressure of about 45 to 70, and an output pressure of about 5 to 7 bars. The amount of the nitrogen subjected to engine expansion in such a medium-pressure turbine can be increased, since because the heating of the cold cycle nitrogen coming from the high-pressure stage is conducted in part by the air expanded in the low-pressure turbine, i.e., having an input of 45 to 70 and an output of 5 to 7 bars. In this way, a greater amount, e.g., about 3 to 10% of cycle nitrogen must be expanded in the medium-pressure turbine, and a lesser amount, e.g., about 10 to 20% must be expanded in a throttle valve. Since turbine expansion is substantially isentropic or compared to throttle valve expansion, the energy consumption of the plant is decreased.

Suitable for conducting the process of this invention is apparatus having a nitrogen liquefaction cycle comprising a compressor, a recompressor, optionally at least one refrigeration machine, at least two heat exchangers, and with at least one low-pressure expansion turbine, wherein the latter is in communication with the low-pressure stage of the rectifying column by way of a heat exchanger integrated in the nitrogen liquefaction cycle.

Under certain operating conditions, it is advantageous to shut down the liquefaction cycle. In this case, it is expedient for conducting the process of this invention to provide a device wherein a bypass line which can be closed off by a valve is disposed between the low-pressure expansion turbine and the low-pressure stage of the rectifying column and in parallel to the heat exchanger traversed by the expanded air. By the use of this bypass line, the pressure losses occurring in the heat exchanger are avoided.

DETAILED DESCRIPTION OF THE DRAWINGS

Figure 1:
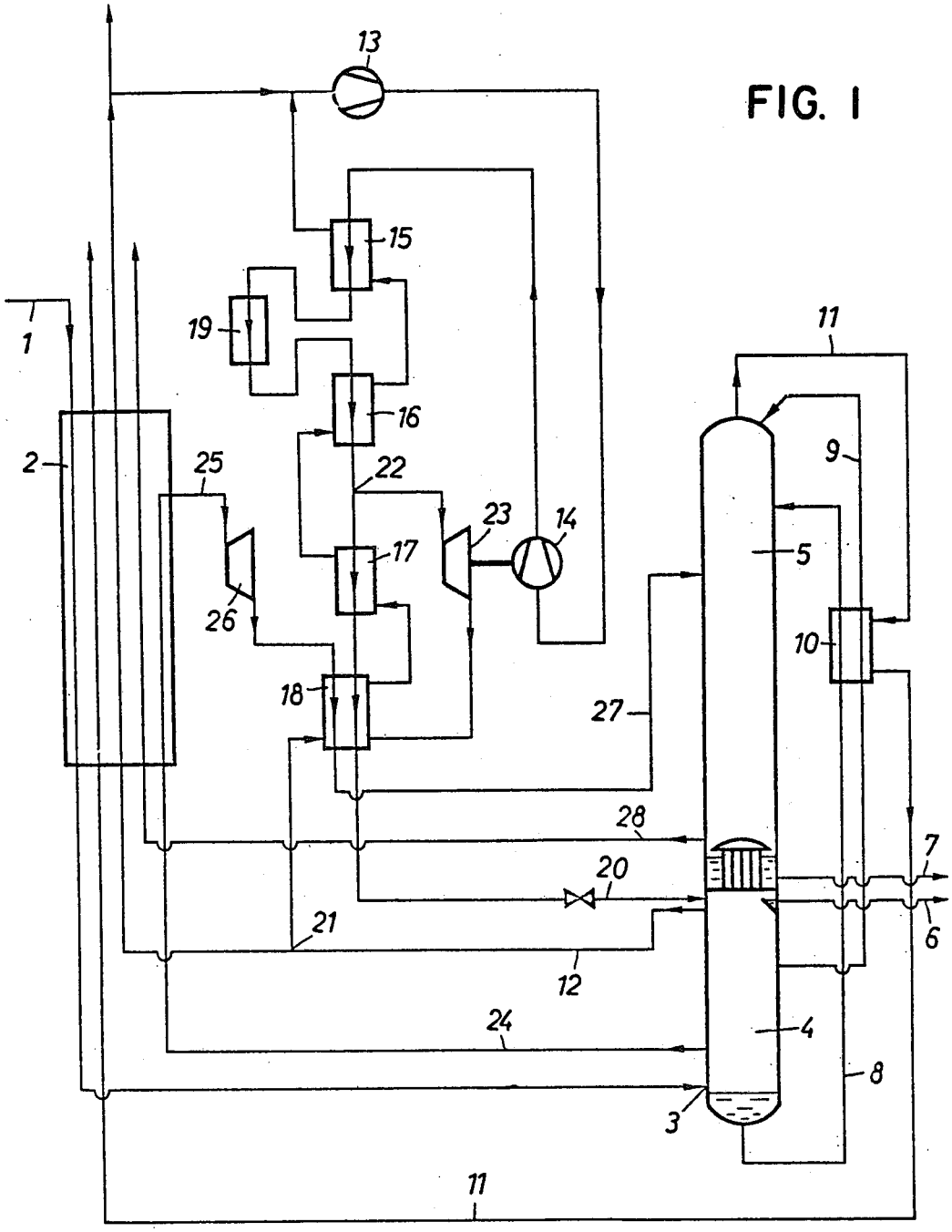
FIG. 1 is a schematic view of a preferred embodiment of the invention depicting a plant for air fractionation according to the invention wherein air is utilized as the compensating stream.
Figure 3:
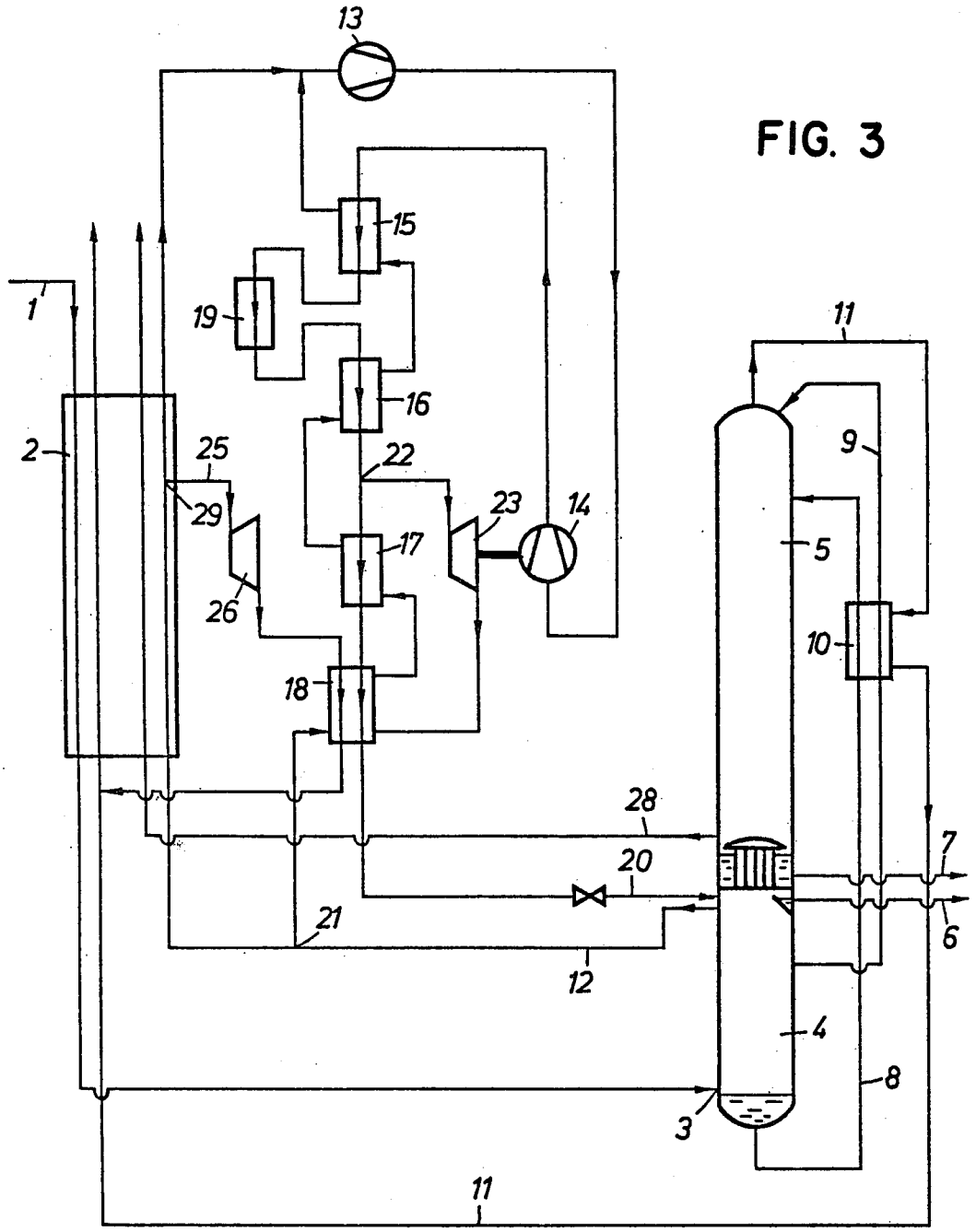
FIG. 3 is a schematic view similar to FIG. 1, except that nitrogen is used as the compensating stream.
Figure 4:
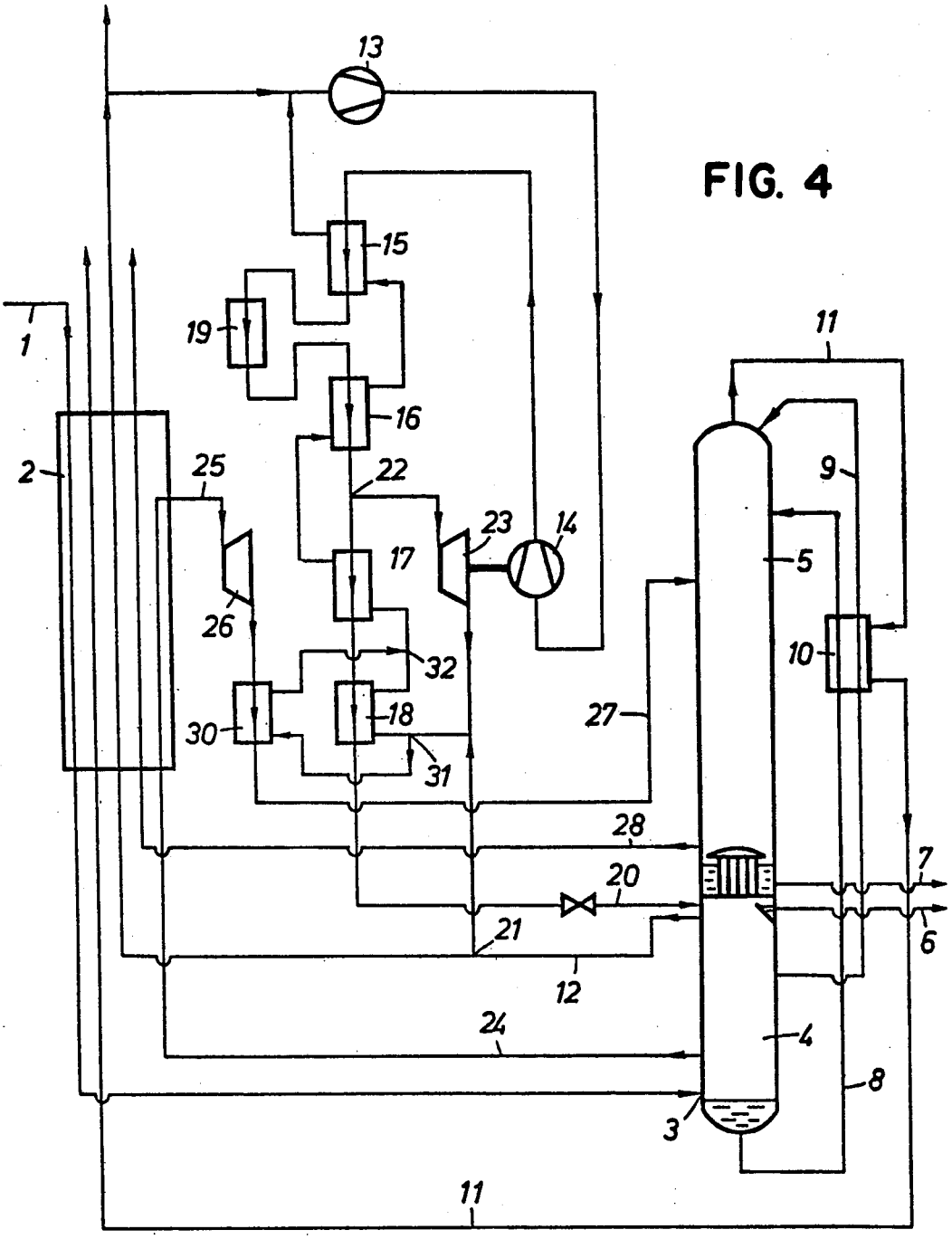
FIG. 4 is a schematic view as in FIG. 1 with a slightly modified mode of operating the process.

Identical parts in FIGS. 1, 3 and 4 bear the same reference numerals.

A primary heat exchanger is denoted by 2. Numerals 10 and 15–18 denote additional heat exchangers. Numberals 4 and 5 designate a high-pressure and a low pressure column, respectively. A low-pressure expansion turbine and a medium-pressure expansion turbine carry reference numerals 26 and 23, respectively.

Compressed and purified air enters the primary heat exchanger 2 at 1 and is introduced, after cooling, into the high-pressure column 4 at point 3. Nitrogen and oxygen are withdrawn in the liquid phase via conduits 6 and 7. Gaseous oxygen is withdrawn from the low-pressure column 5 via conduit 28 and discharged via the primary heat exchanger 2. Through conduits 8 and 9, the oxygen-enriched fraction and the nitrogen-enriched fraction, respectively, are withdrawn from the high-pressure column 4, conducted via the heat exchanger 10, and introduced into the low-pressure column 5 for purposes of further rectification. Via conduit 11, residual gas is withdrawn and discharged from the plant via the primary heat exchanger 2. Gaseous pure nitrogen is discharged from the high-pressure column 4 via conduit 12 and warmed to ambient temperature in the primary heat exchanger 2. A portion thereof is withdrawn from the plant as the final product, another portion, e.g., about 5 to 15% is fed to a compressor 13 of the liquefaction cycle and, after further compression in the recompressor 14, cooled in the heat exchangers 15–18 and in a "Freon" refrigerating unit 19, and finally again introduced via throttling means at 20 into the high-pressure column. A portion, e.g., about 0 to 2% of the nitrogen withdrawn at 12 is branched off at 21 prior to entering the primary heat exchanger 2 and is conducted in the heat exchangers 15–18 countercurrently to the compressed nitrogen to the intake side of the compressor 13. At point 22, a portion, e.g., about 65 to 75% of the compressed cycle nitrogen is branched off, expanded in a medium-pressure expansion turbine 23, and introduced into the heat exchanger 18 together with the partial stream branched off at 21.

To maintain the desired small temperature difference at the cold end of the primary heat exchanger 2, air is withdrawn at 24 from the high-pressure column 4 between the second and third plates thereof, warmed in the primary heat exchanger 2, withdrawn at 25 before the heat-exchange process is finished, and expanded in the low-pressure turbine 26. In accordance with the invention, this expanded air stream is further cooled, e.g., by about 125° to 100° K in heat exchanger 18 before being introduced at 27 into the low-pressure column 5.

Figure 2:
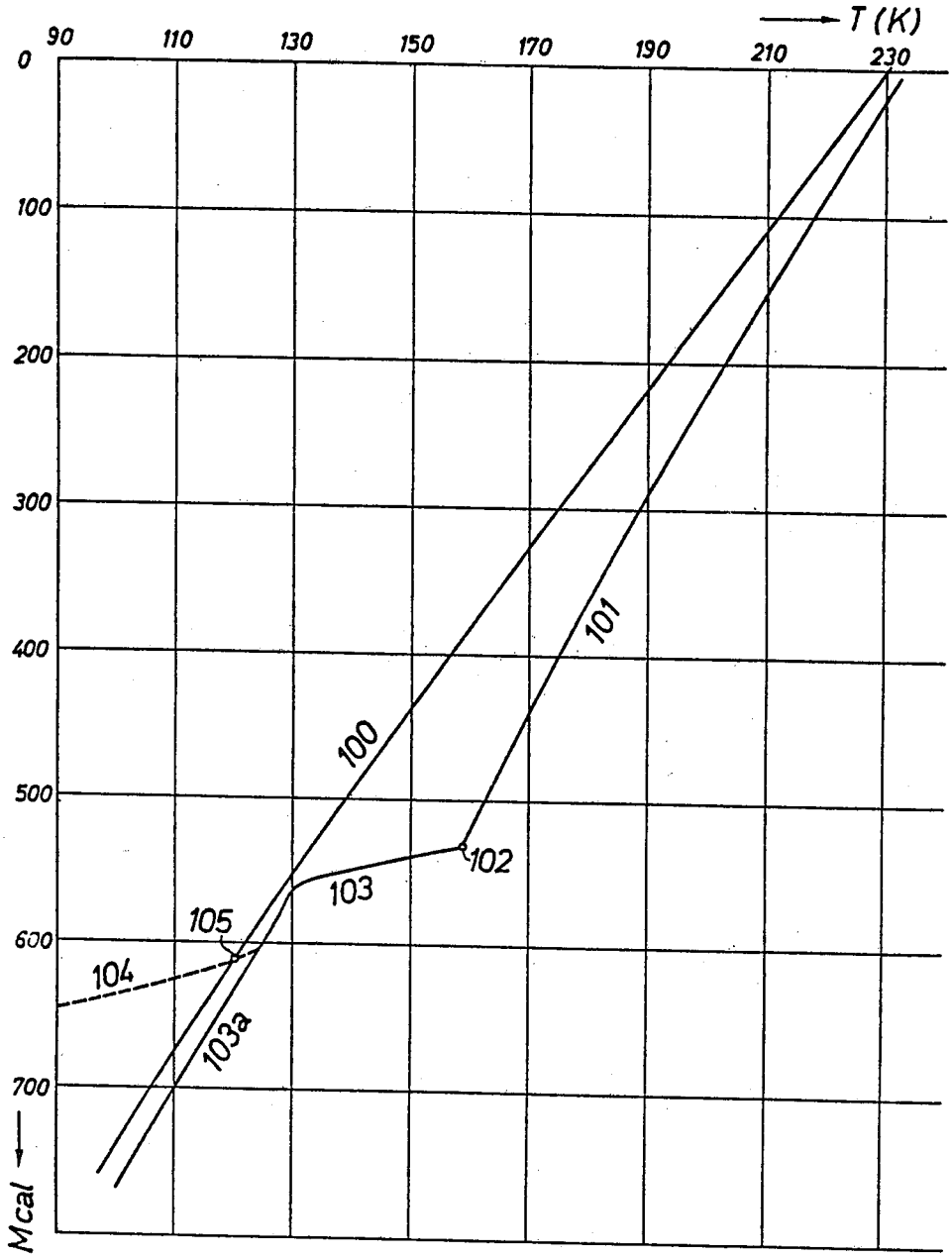
FIG. 2 is a graph of heat capacity or temperature relating to various streams of the process of this invention.

In FIG. 2, the heat of the streams to be warmed and cooled in the heat exchangers is illustrated in Mcal [megacalories] as a function of the absolute temperature.

Curve 100 shows the exchanged heat of the streams to be warmed, and curve 101 shows the exchanged heat of the streams to be cooled up to the branching point 22 of FIG. 1. By branching off a partial stream, the curve 103, starting with point 102, is flatter than curve 101. Owing to this invention, however, curve **103*a* extends almost in parallel to curve 100, whereby uniform, small temperature differences are obtained. The dashed-line curve 104 shows the curve of the exchanged heat without the cooling step of this invention. In order to avoid an intersection of the two curves at point 105, a substantially smaller amount of gas would have to be introduced into the medium-pressure expansion turbine 23 in order to impart a steeper slope to the cooling curve starting with point 102**. It can be seen that larger temperature differences would occur in this case.

FIG. 3 is a schematic view of an air fractionation plant wherein nitrogen is utilized as the compensating stream. A portion, e.g., about 20 to 50% of the nitrogen withdrawn in the gaseous phase from the high-pressure column via conduit 12 is branched off at point 29 and conducted via conduit 25 into the low-pressure expansion turbine. The expanded nitrogen gas, recooled in heat exchanger 18, is withdrawn from the plant by way of reversing exchanger 2.

The process of FIG. 4 differs from that of FIG. 1 in the following respects:

The recooling according to this invention, to which the air leaving the low-pressure expansion turbine is subjected, is conducted in a heat exchanger 30 separate from the heat exchanger 18. For this purpose, a portion, e.g., about 40 to 80% of the cycle nitrogen is branched off at point 31 and, after having been warmed in heat exchanger 30, reintroduced into the cycle at point 32.

Without further elaboration, it is believed that one skilled in the art can, using the preceding description, utilize the present invention to its fullest extent. The following preferred specific embodiment is, therefore, to be construed as merely illustrative, and not limitative of the remainder of the disclosure in any way whatsoever. In the following example, all temperatures are set forth uncorrected in degrees Celsius; unless otherwise indicated, all parts and percentages are by weight.

Referring to the process of FIG. 1, 118,508 $m^3/h$ of purified air under a pressure of about 7 bars is cooled in the primary heat exchanger 2 approximately to its dew point and then introduced into the high-pressure column 4. The plant yields 1,460 $Nm^3/h$ of liquid nitrogen (conduit 6) containing merely 5 p.p.m. of impurities.

Since large amounts of refrigeration values are constantly drawn from the plant with the liquid products, a refrigerating cycle is provided to compensate for these losses:

Via conduit 12, 10,250 $Nm^3/h$ of nitrogen is withdrawn from the head of the high-pressure column, and a predominant amount thereof is warmed in the primary heat exchanger 2 (normally, the connecting conduit from point 21 to the heat exchanger 18 is closed). 8,350 $Nm^3/h$ of this nitrogen is withdrawn from the plant after the warming step as the product, while the remainder (1,900 $Nm^3/h$) is conducted, together with another 17,800 $Nm^3/h$ of nitrogen stemming from the heat exchanger 15, to the intake side of the compressor 13. After compression to 29 bars and additional compression to 36.5 bars in compressor 14, as well as after a recooling step (not shown), the compressed nitrogen is cooled, when following the mode of operation shown in FIG. 1, until it reaches a temperature of 159° K at the cold end of the heat exchanger 16. At point 22, 18,100 $Nm^3/h$ is branched off and expanded in the medium-pressure expansion turbine 23 to 6.53 bars under cooling to 99° K. The other portion (about 1,700 $Nm^3/h$) is subjected to throttle expansion and recycled to the high-pressure column 4.

To set the desired small temperature differences at the cold end of the heat exchanger 2, 16,000 $Nm^3/h$ of prepurified air is withdrawn from the lower part of the high-pressure column 4 (conduit 24), warmed in heat exchanger 2 to 177° K, and expanded in turnbine 26 to 1.44 bars, the air being cooled during this step to 127° K.

According to the invention, this turbine outlet air is cooled in heat exchanger 18° to 104° K, in order to reduce the temperature differences in this heat exchanger, before being introduced into the low-pressure column 5.

The preceding example can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the fractionation of air wherein the air is subjected to rectification in a high pressure column and a low pressure column, wherein in a liquefaction cycle, a first stream of nitrogen is withdrawn in the gaseous phase from the head of the high-pressure column and is heated, compressed and recooled then liquefied by expansion and recycled as liquid to the high-pressure column and wherein a second gaseous stream containing nitrogen is derived from the high pressure column, is preheated and is then expanded through a low-pressure expansion turbine, the improvement which comprises cooling the second gaseous stream expanded in the low-pressure expansion turbine in an indirect heat exchange step with at least a portion of the first stream being heated in the liquefaction cycle.

2. A process according to claim 1 wherein the second gaseous stream expanded in the low-pressure expansion turbine is air withdrawn from the bottom portion of the high-pressure column.

3. A process according to claim 2, further comprising passing resultant cooled air withdrawn from said indirect heat exchange step to the low-pressure column.

4. A process according to claim 3, wherein said resultant cooled air is passed directly to said low-pressure column.

5. A process according to claim 3, wherein the low pressure expansion turbine is operated at 170°–185° K.

6. A process according to claim 2, wherein the low pressure expansion turbine is operated at 170°–185° K.

7. A process according to claim 1, wherein the low pressure expansion turbine is operated at 170°–185° K.

8. A process according to claim 1, wherein said first stream containing nitrogen is split into a first part and a second part directly after withdrawal from the head of the high pressure column, and said first part is passed directly to said indirect heat exchange step for cooling said expanded gasoues stream.

9. A process according to claim 8, wherein said second part of said first stream is heated, compressed and recooled in said liquefaction cycle and prior to the expansion of the recooled second part, a portion of said recooled second part is branched therefrom, turbine-expanded to the pressure of the high-pressure column, and passed to said indirect heat exchange step for cooling said expanded second gaseous stream.

10. A process according to claim 1 wherein the second gaseous stream expanded in the low-pressure expansion turbine is nitrogen.

* * * * *